US005657609A

United States Patent [19]

Spada et al.

[11] Patent Number: 5,657,609

[45] Date of Patent: Aug. 19, 1997

[54] METHOD FOR FORMING HARD PACKETS, IN PARTICULAR FOR CIGARETTES OF THE LIKE, CIGARETTES PACKAGING MACHINE AND COLLAR FOR IMPLEMENTING THE SAID METHOD

[75] Inventors: Valter Spada, Marzabotto; Gianfranco Isani, Caluso, both of Italy

[73] Assignee: SASIB S.p.A., Bologna, Italy

[21] Appl. No.: 568,368

[22] Filed: Dec. 6, 1995

[30] Foreign Application Priority Data

Dec. 7, 1994 [IT] Italy ..... GE94A0136

[51] Int. Cl.[6] ..... B65B 61/00

[52] U.S. Cl. ..... 53/135.1; 53/415; 53/176; 53/234; 53/449

[58] Field of Search ..... 53/415, 135.1, 53/449, 176, 453, 466, 136.1, 559, 578, 579, 234, 225, 580, 172

[56] References Cited

U.S. PATENT DOCUMENTS

| | | | |
|---|---|---|---|
| 1,885,910 | 11/1932 | Gwinn et al. | 53/575 |
| 2,435,878 | 2/1948 | Dunning | 53/387.2 |
| 2,483,063 | 9/1949 | Ray | 53/172 |
| 2,603,925 | 7/1952 | Moore | 53/234 |
| 3,802,325 | 4/1974 | Bardenhagen et al. | 53/575 |
| 3,877,354 | 4/1975 | Schmermund | 53/579 |
| 4,428,177 | 1/1984 | Focke et al. | 53/579 |
| 4,597,246 | 7/1986 | Mattei et al. | 53/234 |

FOREIGN PATENT DOCUMENTS 2238770 6/1991 United Kingdom .

*Primary Examiner*—John Sipos
*Assistant Examiner*—John Paradiso
*Attorney, Agent, or Firm*—Larson and Taylor

[57] ABSTRACT

In a method for forming a hard packet with a flip-up lid (2), in particular for cigarettes or the like, the package is produced by folding a preformed blank around an ordered group of cigarettes (12). During the formation of the packet a collar (3) and a message-bearing coupon (4, 4') are also fed in. The collar (3) is placed between the front face (101) of the box part (1), partly projecting beyond it, on the open side facing the lid (2). The coupon (4, 4') is removably inserted between the collar (3) and the group of cigarettes (12). In the method, the coupon (4, 4') is coupled to the collar (3) and both are then coupled, held together in the correct reciprocal position by use of suction, to the group of cigarettes (12) before the packet-forming stage, at least one aperture (503) being made in a part (403) of the collar which is inside the box part (1), the coupon (4, 4') being additionally held by use of suction via this aperture (503).

8 Claims, 3 Drawing Sheets

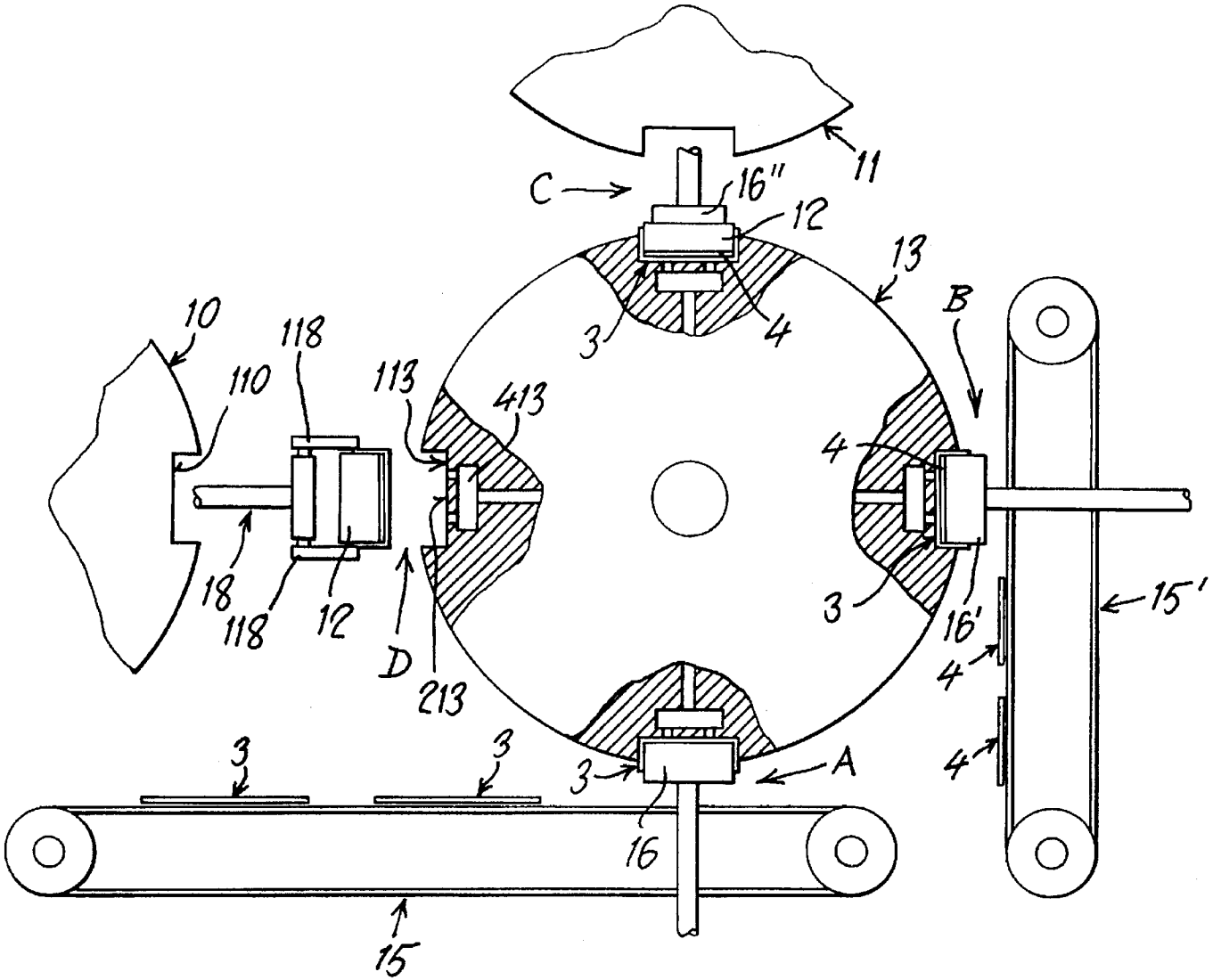
15'
B
16'
4
4
13
11
12
16''
4
4
3
A
16
3
C
3
413
213
113
D
12
118
118
110
18
10
3
3
15

METHOD FOR FORMING HARD PACKETS, IN PARTICULAR FOR CIGARETTES OF THE LIKE, CIGARETTES PACKAGING MACHINE AND COLLAR FOR IMPLEMENTING THE SAID METHOD

BACKGROUND AND SUMMARY OF THE INVENTION

The subject of the invention is a method for forming hard packets, in particular for cigarettes or the like, of the type comprising a box part hinged to a flip-up lid which has at least one side which, in the closed position, partly overlaps a collar fixed to one or more internal sides of the box part and projecting partly beyond the open side of the box part, towards the flip-up lid, and being shaped such that it forms a front opening via which the cigarettes are grasped when the lid is in the open position, a coupon being removably inserted between the said collar and the group of cigarettes and projecting into the front opening via which the cigarettes are grasped, according to which method the coupon and the collar are fed, in the predetermined reciprocal position, to the group of cigarettes during the formation of the hard packet, which involves wrapping a suitably preshaped blank around an ordered group of cigarettes which has optionally previously been wrapped in an internal wrapper.

The coupons, slips or the like, which are removably housed in the hard packets, are used to convey various kinds of messages, in particular for advertising, promotional or similar purposes. Since it is frequently the case that the internal cigarette wrapper is fixed to the inside of the hard packet at the bottom of the front face, inside which the coupon is inserted, and in addition, since the coupon itself must not project beyond the free edge of the collar, or else it will be damaged by the lid, the reciprocal position of the coupon with respect to the collar and to the packet can vary only within extremely restricted limits. It is therefore necessary to feed the coupon with a certain degree of accuracy and to maintain the reciprocal position between the coupon, the collar, the group of cigarettes and the packet blank throughout all the forming stages. Moreover, in order to prevent the coupon from also being glued to the front face of the packet together with the internal wrapper, or to allow greater leeway in the positioning of the coupon, it is advantageous to use coupons of relatively short format, in other words ones which terminate a certain distance from the base of the packet and which therefore do not project at all, or do so only by a very limited amount, beyond the lower edge of that part of the collar which extends inside the box part of the packet.

The object of the invention is therefore to effect a method for forming hard packets of the type described at the outset which enables the coupons to be fed in the correct predetermined position with respect to the collars and to the ordered groups of cigarettes, in a simple and inexpensive way without limiting the production rate, and which enables the said reciprocal position to be effectively maintained during the packet-forming stages.

The invention achieves the above objects with a method of the type described at the outset, in which the coupon and the collar are coupled to the group of cigarettes together, being held in the correct reciprocal position by means of suction and the collar being held in a predetermined position by means of suction acting on two intermediate zones on its surface, while the coupon is held in position with respect to the collar by means of suction acting on its part projecting into the top recess of the collar which constitutes the opening via which the cigarettes are grasped and on at least one opening, hole or the like made at a predetermined point on that part of the collar inside the box part.

According to an additional characteristic, the coupon and the collar are transferred into the unit for forming the hard packet together with the group of cigarettes to which they are coupled, the said three parts being held in the correct reciprocal position by gripping certain areas of the collar against the ordered group of cigarettes.

In particular, when the collar is provided with lateral wings which internally overlap the flanks of the box part of the packet, the method also involves folding the said wings beforehand into their final position, at least prior to transfer of the ordered group of cigarettes together with the coupon and the collar into the unit for forming the packet, preferably at least during the said transfer, by gripping the wings of the collar which overlap the opposing flanks of the group of cigarettes against the corresponding flanks of the latter.

The subject of the invention is a machine for packaging cigarettes or the like in hard packets, comprising a unit for forming ordered groups of cigarettes, which are optionally wrapped in an internal wrapper of the packet, and means for transferring the said ordered groups of cigarettes to a drum which forms the hard packet and is provided with sockets for housing the said ordered groups, with means for feeding the coupons, the collars and the blanks for the hard packets, and with means for folding the said blanks, so as to form the hard packet by wrapping the blanks around the ordered groups of cigarettes.

In order to implement the method according to the invention, the said machine has, in an intermediate position between the unit for forming the ordered groups of cigarettes and for wrapping the latter in an internal wrapper of the packet, and the unit for forming the hard packet, a unit which couples the collars to the coupons and to the ordered groups of cigarettes. The said coupling unit has at least one suction housing which can be moved alternately from one to another of at least four stations including:

- a first collar-feeding station associated with means for feeding the collars and punching means for forming at least one opening in an end of the collar which is designed to be housed inside the box part;
- a second station associated with means for feeding the coupons in the correct predetermined position overlapping the corresponding collar;
- a third station for feeding a group of cigarettes, which is optionally wrapped in an internal wrapper of the packet, in the correct position overlapping the coupon and the collar;
- a station for transferring the group of cigarettes together with the associated coupon and collar into a socket of the wheel for forming the packet, and which is associated with pick-up means which are provided with means for gripping the coupon between the collar and the group of cigarettes, which means act on at least one side of the collar and on at least one opposite side of the group of cigarettes, while the suction housing is provided with at least one suction opening which coincides with a predetermined zone on the surface of the collar, and with at least one suction opening coinciding with the recess of the collar, and with a suction opening in the region of the aperture in the opposite zone of the collar to the said recess.

The invention also provides a collar for implementing the said method in which at least one hole, opening or the like is made in at least one end of the said collar which is designed to be housed inside the box part of the hard packet, preferably in the opposite end to that with the recess constituting the opening via which the cigarettes are grasped, and on the side facing the front face of the packet.

By virtue of the invention it is possible to produce, in a simple and inexpensive way, hard packets provided with removable coupons, in which the coupon is always accurately positioned inside the packet. The machine for forming hard packets according to the invention is not much more complex than conventional machines, since the only additional requirement is a unit for coupling together the collars, coupons and groups of cigarettes and which operates between the unit for forming the group of cigarettes and for wrapping the latter in the internal wrapper of the packet and the unit for forming the hard packet, while the means for transferring and for feeding the said parts would already be provided.

Moreover, the specific shape of the collar, in particular the aperture or apertures in the central part of the latter, enable coupons of various lengths to be used, including ones which are approximately as long as or shorter than the central part of the said collar, additionally allowing the two parts to be always effectively held in their predetermined reciprocal position and guaranteeing greater leeway in positioning.

The invention also relates to other characteristics which further improve the machine and the collar described above and which are discussed hereafter.

BRIEF DESCRIPTION OF THE DRAWINGS

The specific characteristics of the invention and the advantages which derive therefrom will be explained in greater detail in the description of certain preferred embodiments which are illustrated by way of nonlimiting example in the appended drawings, in which:

FIG. 3 illustrates a diagrammatic view of the means for coupling together the collar, the coupon and the ordered group of cigarettes and for transferring them to the drum for folding the hard packet.

DESCRIPTION OF THE PREFERRED EMBODIMENT OF THE INVENTION

Figure 1:
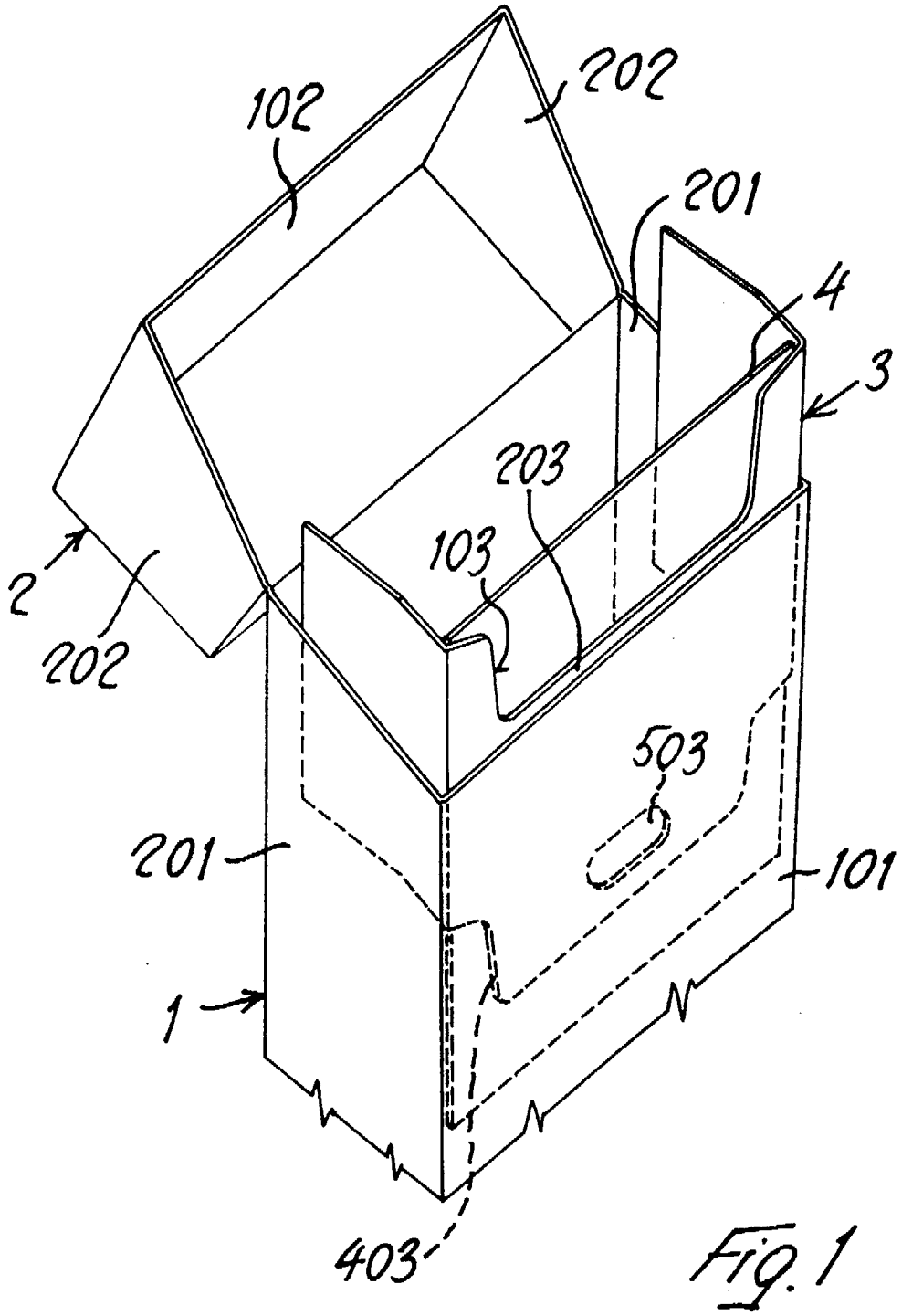
FIG. 1 illustrates a partial perspective view of a hard cigarette packet.

With reference to FIG. 1, a hard cigarette packet comprises a box part 1 and a flip-up lid 2 which is hinged to the rear side of the box part 1. The flip-up lid is made such that it has at least one front side 102 which, in the closed position, aligns with the front face 101 of the box part, in the form of an extension of the latter. In particular, the lid 2 has two sides 202 which correspond to the flanks of the hard packet and which similarly align with the flanks 201 of the box part 1 when the lid is closed. Fixed inside the box part 1, to the inside of the flanks 201 and of the front side 101 is a so-called collar 3 which projects partly out beyond the open side of the box part 1 and which the sides 102 and 202 of the lid overlap when the latter is in the closed position. In its part projecting from the front side 101 of the box part 1, the collar 3 has a recess 103 via which the cigarettes can be grasped. A coupon 4 is inserted between the central part 203 of the collar 3 and the corresponding side of a group of cigarettes (not illustrated) which is optionally wrapped in an internal wrapper of the packet. The coupon 4 can be used for any type of message, or similar function, and can be easily removed from the packet. It is positioned so that it projects into the recess 103 of the collar, with its free edge extending towards the lid 2, approximately in line with the corresponding edge of the collar 3.

Figure 2:
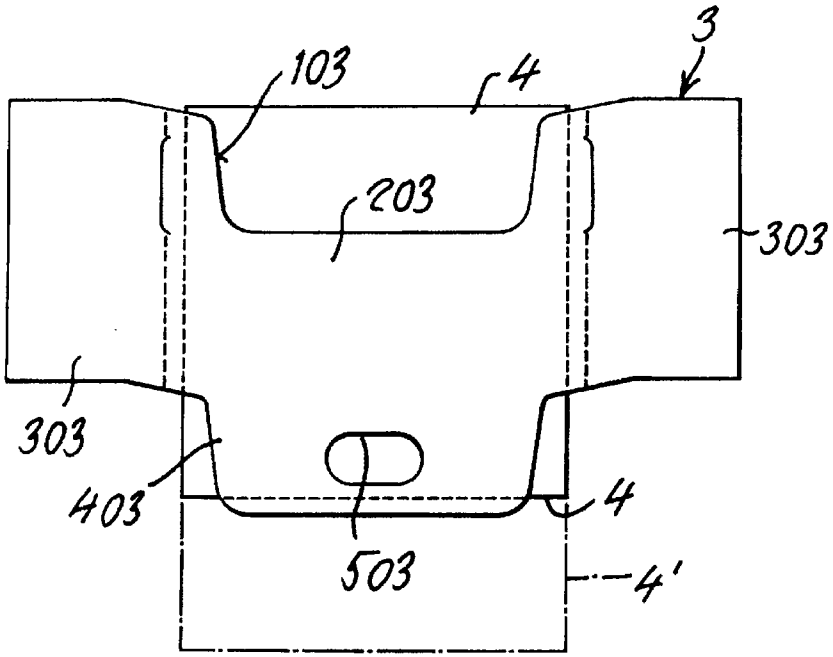
FIG. 2 illustrates a plan view of the blank for a collar, with a long coupon and a short coupon coupled in the predetermined position.

FIG. 2 illustrates a blank for a collar 3. The central part 203 of the collar 3, which is designed to partly overlap the inside of the front side 101 of the box part 1, extends laterally into two wings 303 which constitute the flanks of the collar and are designed to partly overlap the inside of the flanks 201 of the box part 1. The wings 303 are connected to the central part 203 via pre-established fold lines. The central part 203 of the collar 3 has a recess 103 in the zone projecting from the front side 101 of the box part 1, while on the opposite side it has an extended end 403 in the middle zone of which at least one aperture 503 is made. The length of the coupon, in the axial direction of the cigarettes, can be greater than the length of the central part 203 of the collar, as indicated by the coupon 4', or, preferably, its length is approximately equal to or slightly shorter than that of the collar 3, as illustrated by the coupon 4 in FIG. 2. The aperture 503 in the lower end 403 of the collar 3 therefore overlaps the corresponding zone of the coupon 4, 4' which is then accessible via the said aperture by grasping or similar means.

With reference to FIG. 3, in a machine for packaging cigarettes in hard packets with a flip-up lid of the type illustrated in the preceding figures, a unit for coupling the collar 3 to the coupon 4, 4' and then the said two parts together to the ordered group of cigarettes 12 is provided upstream of a unit for forming the hard packet and downstream of a drum 11 for conveying ordered groups of cigarettes 12 wrapped in a foil wrapper. In FIG. 3 the said unit for forming the hard packet consists of a drum 10 which is known per se and which, by virtue of folding means (not illustrated and known per se), forms the hard packet by folding a preshaped blank around each ordered group of cigarettes. A forming device of this type is, for example, described in detail in the published Patent Application EP 0,481,305 belonging to the present applicant. The unit 13 for coupling the collar 3 to the coupon 4, 4' and then the said two parts together to an ordered group of cigarettes 12 can consist of a coupling drum which is mounted so as to rotate in a stepped manner and is inserted in alignment with and between the drum 11 for conveying the ordered groups of cigarettes and the drum 10 for forming the packet. The coupling drum 13 has a plurality of peripheral housings 113 which are brought, in predetermined rotational steps and in succession, to face a station A for feeding the collar 3, a station B for feeding the coupon 4, 4', a subsequent station C for transferring the ordered group of cigarettes 12 from the conveying drum 11 into the housing 113 in the coupling drum 13, and a station D for transferring the ordered group of cigarettes 12 together with the collar 3 and the coupon 4, 4' from the coupling drum 13 to the drum 10 for forming the hard packet.

Figure 4:
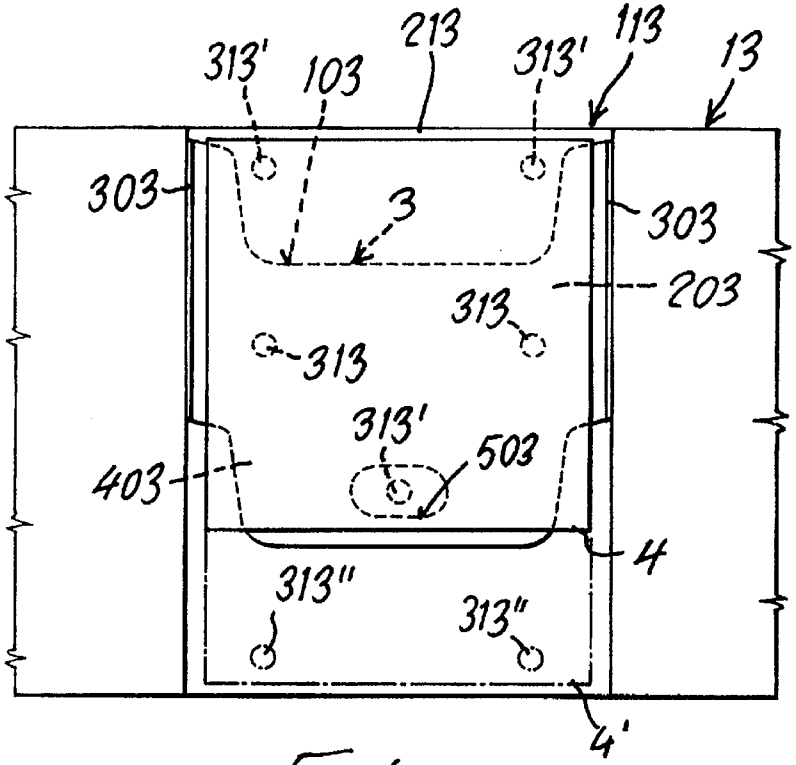
FIG. 4 illustrates a plan view from above of a detail showing the housing and folding recess containing a collar and a short coupon and long coupon respectively.

The housings 113 consist of sockets in the circumference of the coupling drum 13 which have a rectangular transverse section and whose base 213 is positioned tangentially to the drum 13. The dimension of the base 213 corresponds to that of the central part 203 of the collar 3, while at least two suction nozzles 313, which can be connected alternately to a vacuum source or to atmospheric pressure, emerge in the said base 213 wall in zones set apart from one another and coinciding with zones on the central part 203 of the collar 3. Connection to a vacuum source can be effected in a known manner by virtue of distribution elements which rotate together with the drum 13 and are provided with circumferential cables which distribute the vacuum. The collars 3 are picked up from a magazine, for example a magazine of pre-cut collars 3, or from a station in which the collars are die-cut from a continuous web (not illustrated) and are then fed to the station A, one after the other, by virtue of conveyor means 15. The collars 3 may already be provided with the opening 503 in the lower end 403 of the central part 203, or the said aperture 503 can be made in the die-cutting station or in a subsequent punching station (not illustrated). Associated with the conveyor means 15, which consist for example of a pair of conveyor belts, are means 16 for pushing the collars 3 into the housing 113 in the drum 13. Advantageously the said means act on the central part 203 of the collars 3 and are approximately identical in size, so that the wings 303 of the collars are folded perpendicularly to the central part of the latter at the same time as the collars 3 are inserted into the said housings 113. The depth of the housings 113 is such that the lateral wings 303 of the collars 3 project partly radially outwards beyond the external peripheral edge of the housings 113. The collars 3 are held in position in the housings 113 by the suction nozzles 313 which, in station A, are connected to the vacuum source. The base 213 wall of the housings 113 in the coupling drum 13 has additional suction nozzles 313' positioned to form a triangle and two of which coincide with the recess 103 in the central part 203 of the collar 3 and one of which coincides with the aperture 503 in the end 403 of the central part 203 of the collar 3. In the subsequent station B, the housing 113 in the coupling drum 13 which houses a collar 3 is brought to face means 15', for example a pair of conveyor belts, for feeding the coupons 4, 4'. The said coupons 4, 4' are picked up from a magazine of pre-cut coupons or, similarly to the collars 3, from a station in which the latter are cut from a continuous web. The coupons 4, 4' are in a predetermined position with respect to the housing 113 in the coupling drum 13, and therefore with respect to the collar 3, and are inserted into the said housing by virtue of pusher means 16' in a similar way to collars 3. The coupons 4, 4' therefore overlap the inside of the collars 3 in their correct predetermined position and are held in the said position by virtue of suction nozzles 313'. As may be seen in FIG. 4, in the case of coupons 4' of considerable length and which project beyond the end 403 of the collar 3, the housing 113 in the coupling drum 13 can have a base wall of corresponding length, while in addition to the suction nozzles 313 for the coupon 4, 4' which are located in the zone of the recess 103 and in the region of the aperture 503 of the collar 3, it is possible to provide one, two or more additional suction nozzles 313" in that zone of the coupon 4' which projects beyond the end 403 of the collar 3. All the suction nozzles can be connected to a common vacuum chamber 413 which can in turn be connected to the vacuum source. It is also possible to provide suction nozzles in the lateral walls of the housings 113, in the region of the wings 303 of the collar 3.

With an additional rotational step the housing 113, in which the collar 3 and the coupon 4, 4' are overlapped and held in the correct reciprocal position, is brought to face station C. In this station C the ordered groups of cigarettes 12, which are wrapped in an internal wrapper of the packet, for example a foil wrapper, are fed one after the other. The ordered groups of cigarettes 12 are fed in the correct predetermined position with respect to the collar 3 and the coupon 4, 4' in the housing 113 and are inserted in the housing by virtue of pusher means 16". In station D the housing 113, comprising the ordered group of cigarettes 12 overlapping the collar 3 and with the coupon 4, 4' inserted between them, is brought into alignment with an opposing socket 110 in the forming drum 10. The suction nozzles 313, 313', 313" remain connected to the vacuum source during all the rotational steps from station A to station D. In this station D means 18 are provided which transfer together the ordered group of cigarettes 12, the coupon 4, 4' and the collar 3 from the coupling drum 13 to the forming drum 10. In the example shown in FIG. 3, these means consist of a clamp which can be moved in the radial direction of the two opposite drums 10, 13 and which is provided with opposing jaws 118 which can be moved transversely to the ordered group of cigarettes 12 and which overlap the latter, the jaws gripping the flank of the said ordered group of cigarettes 12 via the ends of the lateral wings 303 of the collar 3 which project out beyond the lateral walls of the housing 113 in the coupling drum 13. Therefore, the collar 3 is held firmly against the group of cigarettes 12 during the entire transfer operation and with it also the coupon 4, 4' which is held in position with respect to the said collar 3 and to the ordered group of cigarettes 12. The collar 3 and the coupon 4, 4' are transferred in this way into the sockets 110 in the unit 10 for forming the hard packet, together and in the correct reciprocal position, while the blank is subsequently folded around them in order to form the hard packet, in relation to which all the elements are in the intended position for the finished packet.

Needless to say, the invention is not limited to the embodiments described above and illustrated and can, on the contrary, be amply varied and modified, in particular in terms of construction. Despite the fact that the coupling unit and the unit for forming the hard packet have been illustrated in the form of drums with radial sockets, the method, the collar and the device according to the invention can be applied to any type of method and of device for forming hard packets, whether for cigarettes or for other types of rod-shaped products, without thereby departing from the underlying principle of the invention.

We claim:

1. A machine for packaging groups of cigarettes or the like in respective hard packets, each packaged hard packet including (1) a longitudinal box part with an open side and provided with a flip-up top lid hinged thereto which closes the open side, (2) a collar with a lower part fixed to at least one internal side of the box part and with a projecting part projecting partly beyond the open side of the box part so that in the closed position the lid overlaps the projecting part, the collar also including a top recess in the projecting part via which the cigarettes in the box part are grasped when the lid is in the open position, and (3) a coupon removably located between the collar and the group of cigarettes and projecting longitudinally into the top recess of the collar, said machine comprising:

a coupling unit including a suction housing which is cyclically movable, said suction housing having first, second, and third suction nozzles;

a first collar-feeding station to which said suction housing is presented, said collar-feeding station including a collar feeding means for sequentially feeding collars with at least one opening in the lower part of each collar, and a collar pusher means for inserting a respective collar into the presented said suction housing of said coupling unit such that the collar is presented with a predetermined zone thereof opposite said first suction nozzle whereby said collar is held in said suction housing by said first suction nozzle with said second suction nozzle located in the top recess and the third suction nozzle located in the formed opening of the collar;

a second coupon-feeding station to which said suction housing is subsequently presented, said coupon-feeding station including a coupon feeding means for sequentially feeding coupons to a predetermined position overlapping the collar in the presented said suction housing, and a coupon pusher means for pushing a respective coupon onto the collar in the presented said suction housing of the coupling unit such that the coupon is held in the suction housing against the collar by the second and third suction nozzles;

a third cigarette-feeding station to which said suction housing is subsequently presented, said cigarette-feeding station including a group forming unit for forming ordered groups of cigarettes, and a group pusher means for pushing a respective group of cigarettes onto the coupon and collar in the presented suction housing to form a collared group;

a fourth transfer station to which the suction housing with the collared group is presented, said fourth station including a pack forming unit for forming hard packets about collared groups, said pack forming unit including a socket, and a transfer means for transferring a respective collared group from the suction housing to the socket of the forming unit, said transfer means including a gripping means for gripping the collared group by acting on one side of the collar and an opposed side of the group of cigarettes to thereby hold the coupon in place during the transfer.

2. A machine for packaging as claimed in claim 1 wherein said coupling unit includes a coupling drum including a plurality of said suction housings spaced circumferentially thereabout; and wherein each said suction housing includes a support surface having a transverse dimension which corresponds to a transverse dimension of a central part of the collar which overlaps a front side of the box part, at least two of said first suction nozzles which are spaced from one another and which thereby hold the collar in the suction housing at two spaced locations, at least two of said second suction nozzles which are spaced from one another and which thereby hold the coupon in the suction housing at two spaced locations in the top recess of the collar, and a means for selectively connecting said first, second, and third suction nozzles to a vacuum source when each said suction nozzle is required to hold said collar or said coupon in said suction housing or to atmospheric pressure when each said suction nozzle is not required to hold said collar or said coupon in said suction housing.

3. A machine for packaging as claimed in claim 2 wherein said support surface of each said suction housing has (1) a length greater than a length of said collars such that said support surface includes a surface portion located below said lower part of said collar when said collar is located on said support surface, and (2) at least two additional fourth suction nozzles located in the surface portion and spaced from one another.

4. A machine for packaging as claimed in claim 2 wherein each said suction housing also includes opposed lateral walls which extend perpendicular to said support surface;

wherein the collars each include lateral wings attached laterally on opposite sides of the central part; and wherein said collar pushing means includes a pusher which engages the central part of the respective collar and which has a lateral dimension which corresponds to that of the central part whereby as the respective collar is inserted into the suction housing the lateral wings are folded perpendicular to the central part and along the lateral walls.

5. A machine for packaging as claimed in claim 4 wherein said lateral walls of said suction housing have a depth dimension which is shorter than a width dimension of said lateral wings and a depth dimension of flanks of the group of cigarettes such that portions of said lateral wings and flanks project beyond said suction housing after insertion therein.

6. A machine for packaging as claimed in claim 5 wherein said transfer means includes a slidably supported clamp provided with movable jaws which grip portions of the flanks of the group of cigarettes and portions of the lateral wings which project out of said suction housing.

7. A machine for packaging as claimed in claim 1 wherein said coupling unit includes a coupling drum rotatable in steps about a longitudinal axis thereof, said coupling drum including a plurality of said suction housings spaced circumferentially thereabout, each said suction housing having a tangentially oriented support surface against which a respective central part of the collar is inserted, opposed lateral walls which extend perpendicular to said support surface against which respective lateral wings of the collar are inserted;

wherein said group forming unit includes a group forming drum which rotates about an axis parallel to the longitudinal axis of said coupling drum and which said group forming drum is located adjacent the circumference of said coupling drum whereby during each rotational step of said coupling drum a respective said suction housing is presented opposite said group forming drum for reception of a respective group of cigarettes from said group forming drum; and wherein said pack forming unit includes a pack forming drum which rotates about an axis parallel to the longitudinal axis of said coupling drum and which said pack forming drum is located adjacent the circumference of said coupling drum whereby during each rotational step of said coupling drum a respective said suction housing is presented opposite said pack forming drum for transfer of the collared group to the pack forming drum.

8. A machine for packaging as claimed in claim 1, wherein said first collar-feeding station further includes a punching means for forming the at least one opening in the lower part of each collar prior to feeding the collar to the collar pusher means.

* * * * *